US011047405B2

(12) United States Patent
Jung et al.

(10) Patent No.: US 11,047,405 B2
(45) Date of Patent: Jun. 29, 2021

(54) SYSTEM FOR CONTROLLING CONSTRUCTION MACHINE AND METHOD FOR CONTROLLING CONSTRUCTION MACHINE

(71) Applicant: DOOSAN INFRACORE CO., LTD., Incheon (KR)

(72) Inventors: Woo-Yong Jung, Incheon (KR); Yong-Lak Cho, Incheon (KR); Chang-Mook Kim, Incheon (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 0 days.

(21) Appl. No.: 16/491,736

(22) PCT Filed: Mar. 6, 2018

(86) PCT No.: PCT/KR2018/002673
§ 371 (c)(1),
(2) Date: Sep. 6, 2019

(87) PCT Pub. No.: WO2018/164465
PCT Pub. Date: Sep. 13, 2018

(65) Prior Publication Data

US 2020/0040917 A1 Feb. 6, 2020

(30) Foreign Application Priority Data

Mar. 6, 2017 (KR) ..... 10-2017-0028246

(51) Int. Cl.
*F15B 20/00* (2006.01)

(52) U.S. Cl.
CPC ..... *F15B 20/007* (2013.01); *F15B 2211/45* (2013.01); *F15B 2211/853* (2013.01)

(58) Field of Classification Search
CPC ..... F15B 2211/3116; F15B 2211/45; F15B 2211/853; F15B 20/007; E02F 9/2282
See application file for complete search history.

(56) References Cited

U.S. PATENT DOCUMENTS 5,992,147 A 11/1999 Tajima
7,252,030 B2 * 8/2007 Kim ..... F15B 11/0423 91/365

(Continued)

FOREIGN PATENT DOCUMENTS

CN 102575690 A 7/2012
EP 0844338 A2 5/1998

(Continued)

OTHER PUBLICATIONS

International Search Report dated May 25, 2018 in connection with counterpart International Patent Application No. PCT/KR2018/002673.

(Continued)

*Primary Examiner* — F Daniel Lopez
(74) *Attorney, Agent, or Firm* — Hauptman Ham, LLP

(57) ABSTRACT

A control system for construction machinery, includes a hydraulic pump, at least one control valve installed in a center bypass line connected to the hydraulic pump and configured to control a flow direction of a working oil discharged from the hydraulic pump to selectively supply the working oil to an actuator, a bypass control valve installed downstream from the control valve in the center bypass line to variably control an amount of the working oil draining to a drain tank through the center bypass line, and a controller configured to control operations of the hydraulic pump and the bypass control valve according to a manipu- (Continued)

lation signal of an operator and to open the bypass control valve according to pump peak occurrence to reduce a pump peak.

15 Claims, 7 Drawing Sheets

(56) References Cited

U.S. PATENT DOCUMENTS

| | | | | |
|---|---|---|---|---|
| 9,051,712 | B2 * | 6/2015 | Kodaka | E02F 9/2285 |
| 9,086,004 | B2 * | 7/2015 | Lee | E02F 9/2292 |
| 2015/0059331 | A1 | 3/2015 | Hashimoto | |

FOREIGN PATENT DOCUMENTS

| | | | |
|---|---|---|---|
| EP | 0844338 | A3 | 2/1999 |
| JP | 2007-127275 | A | 5/2007 |
| JP | 2016-148378 | A | 8/2016 |
| JP | 2016-223551 | A | 12/2016 |
| KR | 10-0641393 | B1 | 11/2006 |
| KR | 10-2010-0051315 | A | 5/2010 |
| KR | 10-0998614 | B1 | 12/2010 |
| KR | 10-2012-0086288 | A | 8/2012 |

OTHER PUBLICATIONS

Chinese Office Action dated Jan. 19, 2021, in connection with corresponding Chinese Patent Application No. 201880015922.6.
European Office Action dated Mar. 16, 2021, in connection with corresponding European Patent Application No. 18764213.7.

* cited by examiner

SYSTEM FOR CONTROLLING CONSTRUCTION MACHINE AND METHOD FOR CONTROLLING CONSTRUCTION MACHINE

CROSS REFERENCE TO RELATED APPLICATION

This present application is a national stage filing under 35 U.S.C § 371 of PCT application number PCT/KR2018/002673 filed on Mar. 6, 2018 which is based upon and claims the benefit of priority to Korean Patent Application No. 10-2017-0028246 filed on Mar. 6, 2017 in the Korean Intellectual Property Office. The disclosures of the above-listed applications are hereby incorporated by reference herein in their entirety.

TECHNICAL FIELD

The present invention relates to a control system for construction machinery and a control method for construction machinery. More particularly, the present invention relates to a control system for construction machinery including a pressure control type electronic hydraulic pump and a control method for construction machinery using the same.

BACKGROUND ART

A hydraulic system for construction machinery may be divided into an open center type and a closed center type, in a hydraulic system of an excavator of the closed center type using a pressure control type electronic hydraulic pump, in case of a joystick sudden stop manipulation, a pressure peak occurs instantaneously by a working oil discharged from the hydraulic pump while a swash plate angle of the hydraulic pump is decreased. In order to reduce the pressure peak, a pump peak reducing valve (PPRV) may be used. However, an extra space and piping arrangement may be required and costs may be increased.

DISCLOSURE OF THE INVENTION

Problems to be Solved

An object of the present invention provides a control system for construction machinery capable of reducing a pump peak at low cost.

Another object of the present invention provides a control method for construction machinery using the above control system.

Means to Solve the Problems

According to example embodiments, a control system for construction machinery, includes a hydraulic pump, at least one control valve installed in a center bypass line connected to the hydraulic pump and configured to control a flow direction of a working oil discharged from the hydraulic pump to selectively supply the working oil to an actuator, a bypass control valve installed downstream from the control valve in the center bypass line to variably control an amount of the working oil draining to a drain tank through the center bypass line, and a controller configured to control operations of the hydraulic pump and the bypass control valve according to a manipulation signal of an operator and to open the bypass control valve according to pump peak occurrence to reduce a pump peak.

In example embodiments, the controller may include a sudden stop determiner determining whether or not a sudden stop manipulation of the actuator occurs, based on a joystick manipulation signal, a calculator determining an opening area of the bypass control valve in case of the sudden stop manipulation of the actuator, and an output portion outputting a control signal for opening the bypass control valve according to the calculated opening area.

In example embodiments, the calculator may calculate an opening duration or a closing inclination of the bypass control valve based on a size and/or duration time of a predicted pump peak.

In example embodiments, the controller may control to open the bypass control valve when it is determined that the pump peak occurs based on a positional signal of the actuator or a pressure signal of a working oil supply line.

In example embodiments, in case of no sudden stop manipulation, the controller may control to close the bypass control valve. In example embodiments, the controller may control to open the bypass control valve in advance by a predetermined minimum area when an amount of the working oil discharged from the hydraulic pump is greater than a predetermined value before the sudden stop manipulation.

In example embodiments, the controller may control to open the bypass valve at an initial engine ignition time or a warm up after ignition of the construction machinery In example embodiments, the controller may control to close the bypass control valve during a multiple operation of the actuators even in case of the sudden stop manipulation of the actuator.

In example embodiments, the control system for construction machinery may further include an electromagnetic proportional control valve to apply a pilot pressure corresponding to the control signal inputted from the controller to control the opening area of the bypass control valve.

In example embodiments, the control system for construction machinery may further include a second hydraulic pump, a second control valve installed in a second center bypass line connected to the second hydraulic pump and configured to control a flow direction of a working oil discharged from the second hydraulic pump to selectively supply the working oil to a second actuator, a second bypass control valve installed downstream from the second control valve in the second center bypass line to variably control an amount of the working oil draining to a drain tank through the second center bypass line, and a second electromagnetic proportional control valve to apply a pilot pressure corresponding to the control signal inputted from the controller to control an opening area of the second bypass control valve.

In example embodiments, the control system for construction machinery may further include a pump regulator configured to adjust a swash plate angle of the hydraulic pump according to the control signal inputted from the controller.

According to example embodiments, in a control method for construction machinery, a hydraulic system including a hydraulic pump, at least one control valve installed in a center bypass line connected to the hydraulic pump to control an operation of an actuator, and a bypass control valve installed downstream from the control valve in the center bypass line to variably control an amount of the working oil draining to a drain tank through the center bypass line is provided. A pressure signal of a supply line of the working oil or a positional signal of the actuator are received to determine whether or not a pump peak occurs.

The bypass control valve is opened in case of the pump peak occurrence to reduce the pump peak.

In example embodiments, determine whether or not a pump peak occurs may include determining an opening area of the bypass control valve based on a size and/or duration time of a predicted pump peak in case of a sudden stop manipulation of the actuator.

In example embodiments, the control method for construction machinery may further include closing the bypass control valve in case of no sudden stop manipulation.

In example embodiments, the control method for construction machinery may further include opening the bypass control valve in advance by a predetermined minimum area when an amount of the working oil discharged from the hydraulic pump is greater than a predetermined value before the sudden stop manipulation.

In example embodiments, the control method for construction machinery may further include opening the bypass control valve at an initial engine ignition time or a warm up after ignition of the construction machinery.

In example embodiments, the control method for construction machinery may further include closing the bypass control valve during a multiple operation of the actuator even in case of the sudden stop manipulation.

In example embodiments, opening the bypass control valve in case of the pump peak occurrence may include applying a pilot pressure for opening the bypass control valve according to a calculated opening area, to the bypass control valve through an electromagnetic proportional control valve.

In example embodiments, the control method for construction machinery may further include controlling a swash plate angle of the hydraulic pump according to the manipulation signal of an operator of the actuator.

Effects of the Invention

According to example embodiments, in case of a joystick sudden stop manipulation, a bypass control valve installed in a center bypass line may be opened such that a working oil discharged from a hydraulic pump may return to a drain tank through the center bypass line. In case of no joystick sudden stop manipulation, the bypass control valve may be closed.

Thus, in a closed center type of a hydraulic system, in case of the joystick sudden stop manipulation, a pump peak which occurs due to physical dynamic characteristic differences between the hydraulic pump and the control valve may be prevented.

However, the effect of the invention may not be limited thereto, and may be expanded without being deviated from the concept and the scope of the present invention.

BEST MODE FOR CARRYING OUT THE INVENTION

Figure 1:
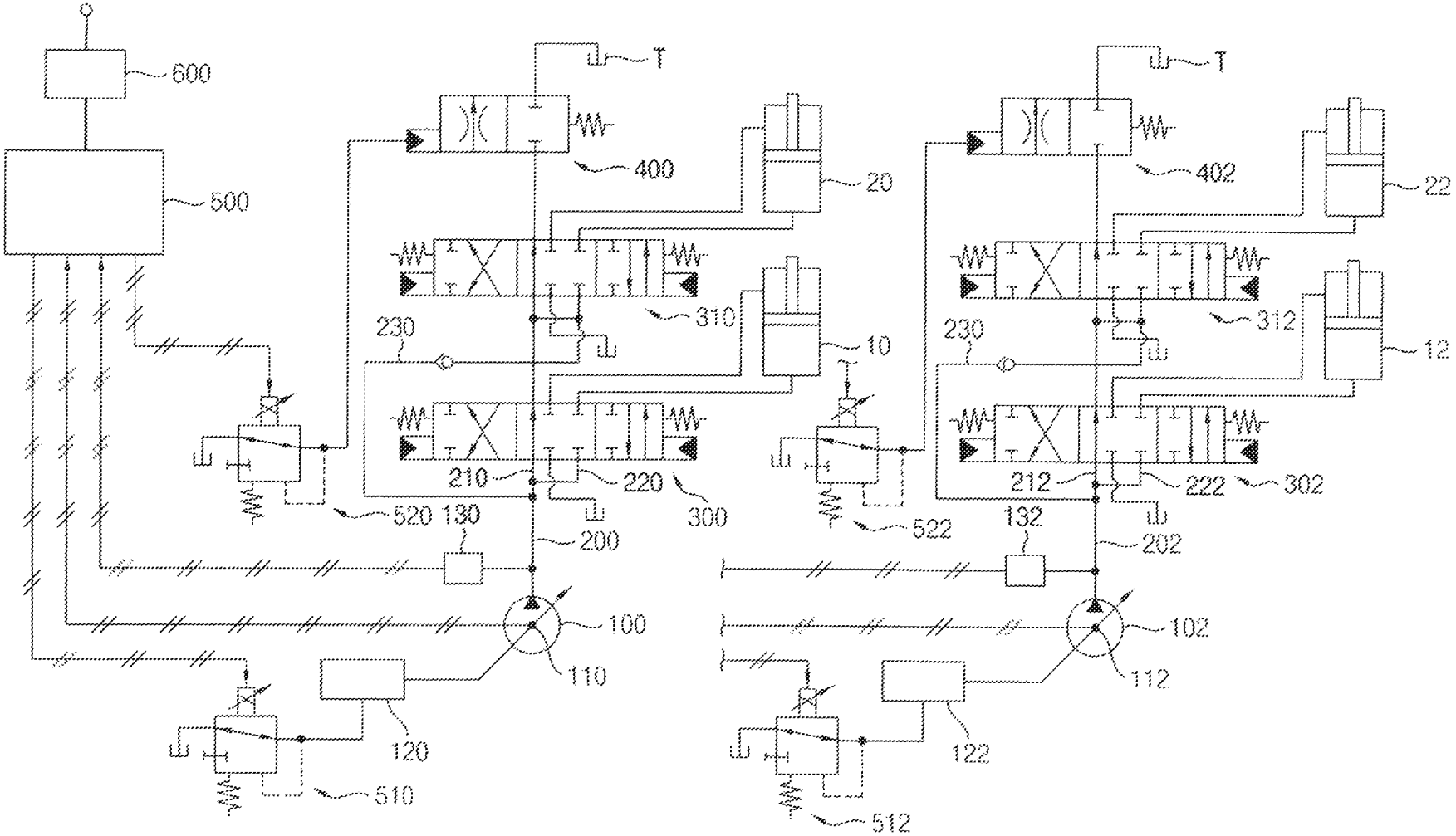
FIG. 1 is a hydraulic circuit diagram illustrating a control system for construction machinery in accordance with example embodiments.

Hereinafter, preferable embodiments of the present invention will be explained in detail with reference to the accompanying drawings.

In the drawings, the sizes and relative sizes of components or elements may be exaggerated for clarity.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

The terminology used herein is for the purpose of describing particular example embodiments only and is not intended to be limiting of example embodiments. As used herein, the singular forms "a," "an" and "the" are intended to include the plural forms as well unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the aft to which example embodiments belong. It will be further understood that terms, such as those defined in commonly used dictionaries, should be interpreted as having a meaning that is consistent their meaning in the context of the relevant art and will not be interpreted in an idealized or overly formal sense unless expressly so defined herein.

Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art.

Figure 2:
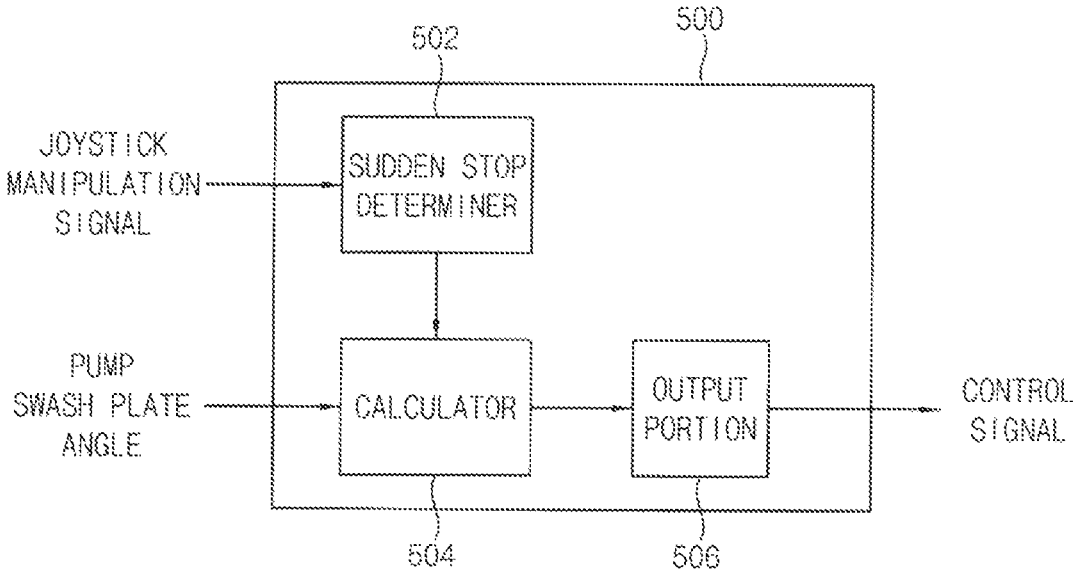
FIG. 2 is a block diagram illustrating a controller of the control system in FIG. 1.
Figure 3:
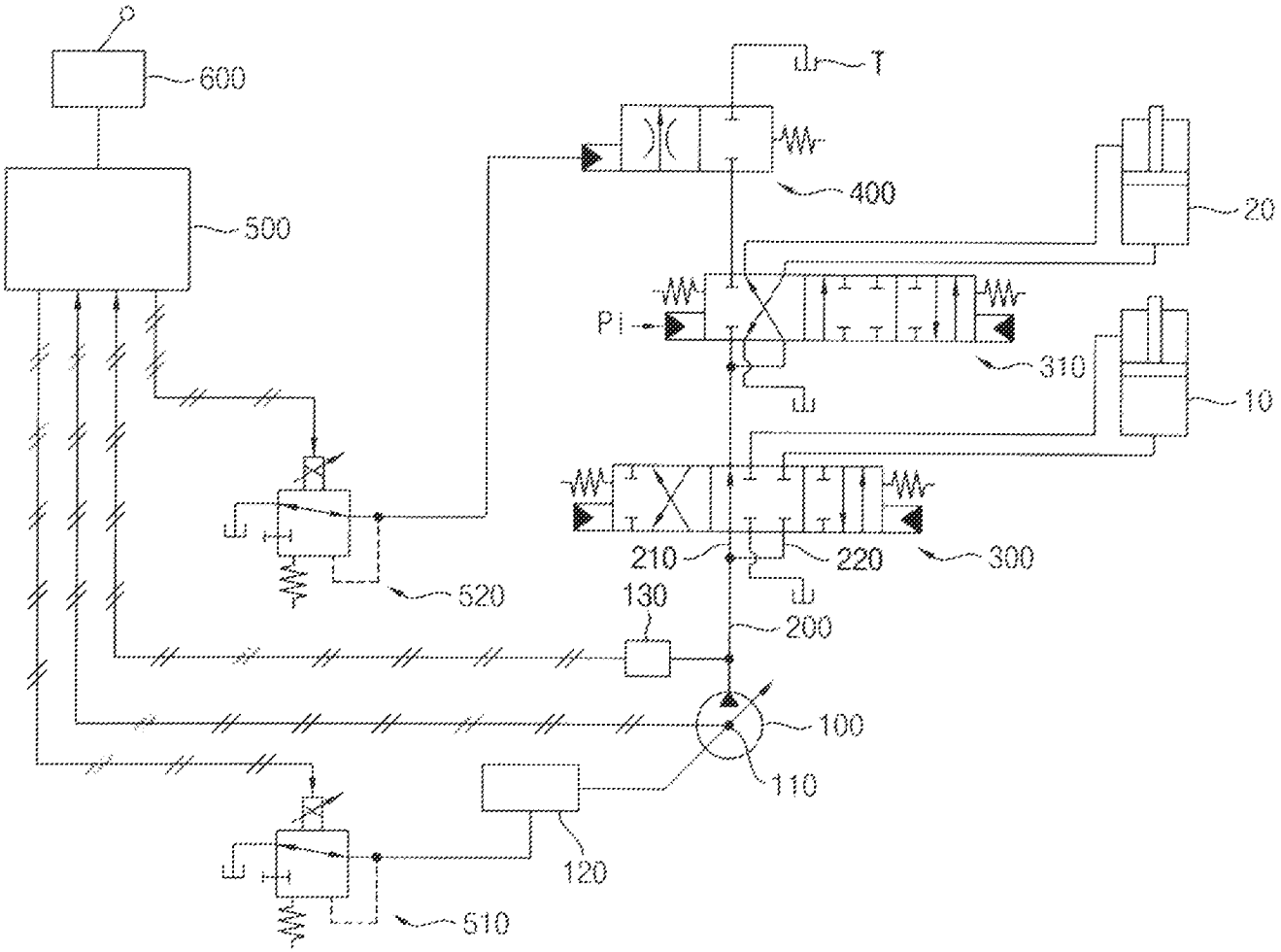
FIG. 3 is a hydraulic circuit diagram illustrating the control system in a single operation of an actuator in FIG. 1.
Figure 4:
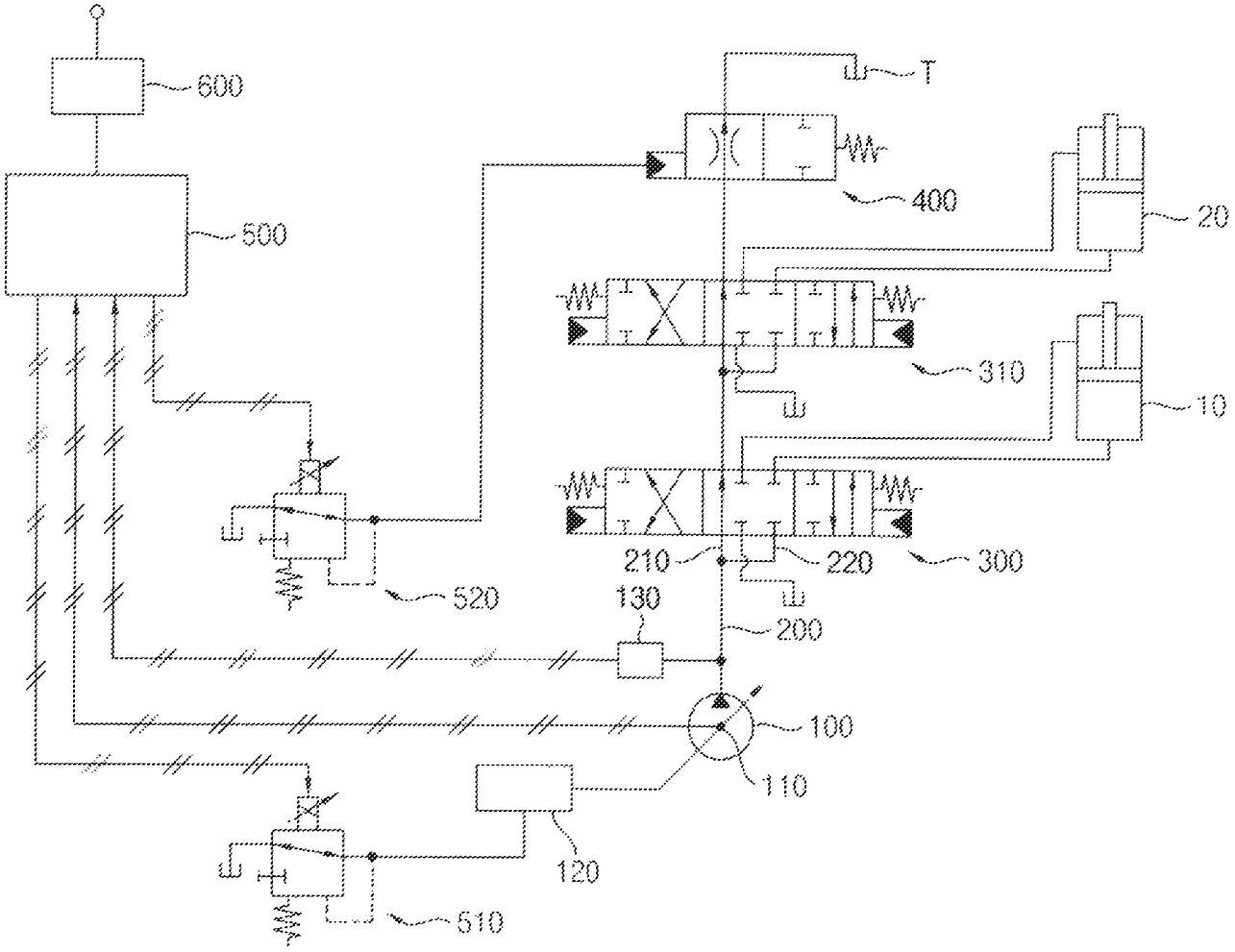
FIG. 4 is a hydraulic circuit diagram illustrating the control system in a sudden stop operation of an actuator in FIG. 1.
Figure 5:
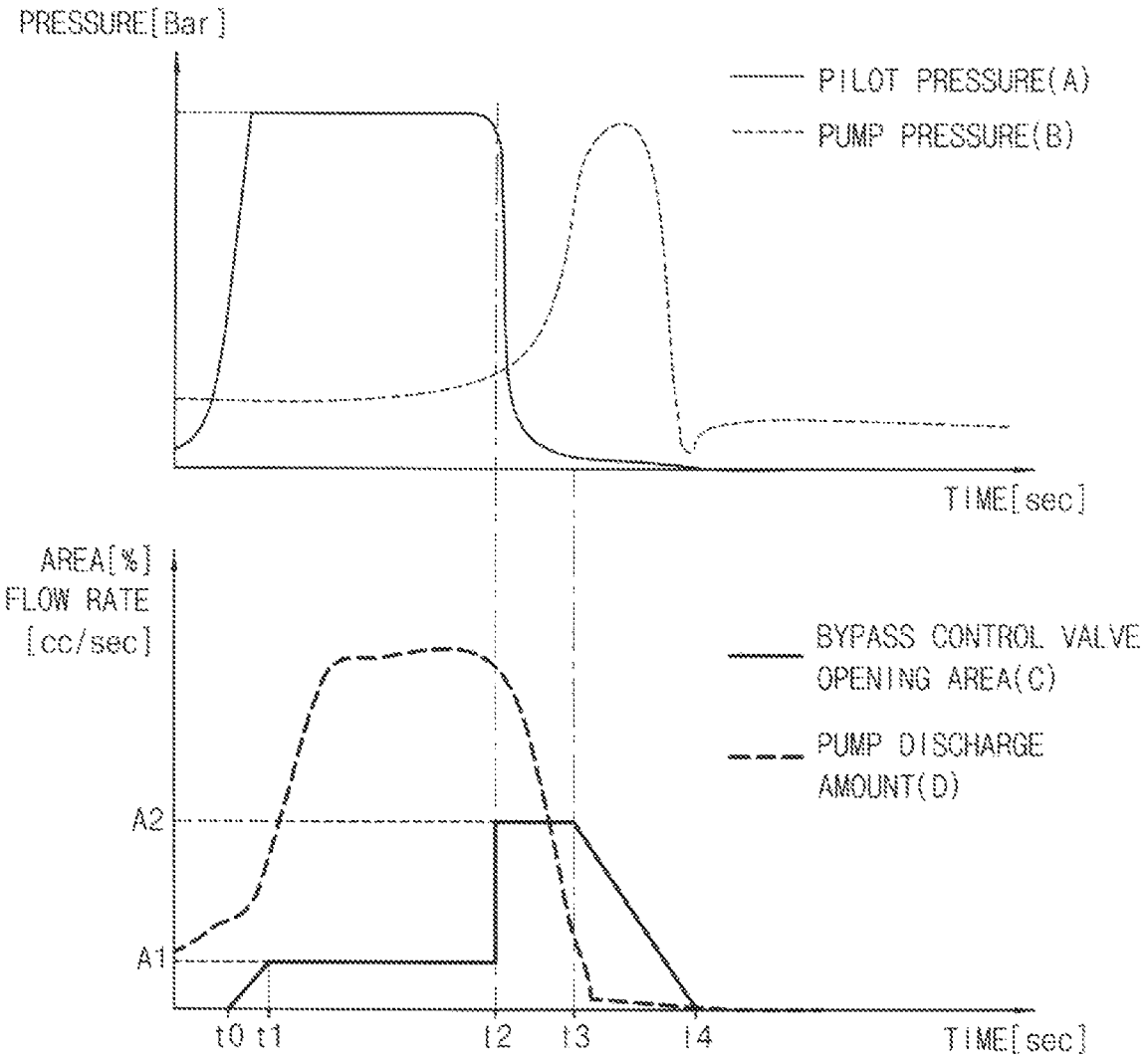
FIG. 5 is graphs illustrating an opening area of a bypass control valve and a pump discharge amount in the sudden stop operation of the actuator in FIG. 4.

FIG. 1 is a hydraulic circuit diagram illustrating a control system for construction machinery in accordance with example embodiments. FIG. 2 is a block diagram illustrating a controller of the control system in FIG. 1. FIG. 3 is a hydraulic circuit diagram illustrating the control system in a single operation of an actuator in FIG. 1. FIG. 4 is a hydraulic circuit diagram illustrating the control system in a sudden stop operation of an actuator in FIG. 1. FIG. 5 is graphs illustrating an opening area of a bypass control valve and a pump discharge amount in the sudden stop operation of the actuator in FIG. 4.

Referring to FIGS. 1 to 5, a control system for construction machinery may include a first hydraulic pump 100, at least one control valve 300, 310 configured to control a flow direction of a working oil discharged from the first hydraulic pump 100 to control actuators 10, 20, a first bypass control valve 400 installed in a first center bypass line 210 downstream from the control valve to variably control amount of the working oil draining to a drain tank through the first center bypass line 210, and a controller 500 configured to control operations of the first hydraulic pump 100, the control valve 300, 310 and the first bypass control valve 400 according to pump peak occurrence.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

The construction machinery may include a lower travelling body, an upper swinging body mounted to be capable of swinging on the lower travelling body, and a cabin and a front working device installed in the upper swinging body. The front working device may include a boom, an arm and a bucket. A boom cylinder for controlling a movement of the boom may be installed between the boom and the upper swinging body. An arm cylinder for controlling a movement of the arm may be installed between the arm and the boom. A bucket cylinder for controlling a movement of the bucket may be installed between the bucket and the arm. As the boom cylinder, the arm cylinder and the bucket cylinder expand or contract, the boom, the arm and the bucket may implement various movements, to thereby perform various works.

In example embodiments, the first hydraulic pump 100 may be connected to an electric motor (not illustrated) or an engine (not illustrated) through a power transferring device such that a power of the engine may be transferred to the first hydraulic pump 100.

For example, the first hydraulic pump 100 may include a pressure control type electronic hydraulic pump. A discharged amount of the first hydraulic pump 100 may be determined by a swash plate angle. The swash plate angle of the first hydraulic pump 100 may be adjusted according to a pump control signal inputted from the controller 500.

In particular, the swash plate angle of the first hydraulic pump 100 may be adjusted by a first pump regulator 120. The first pump regulator 120 may be connected to a pilot pump (not illustrated) via a first electromagnetic proportional control valve 510. The pilot pump may be connected to an output axis of the engine, and as the output axis of the engine rotates, the pilot pump may be driven to discharge a pilot working oil. For example, the pilot pump may include a gear pump. In this case, the working oil and the pilot working oil may include substantially the same material.

The pilot working oil may be supplied to the first pump regulator 120 through the first electromagnetic proportional control valve 510. The first electromagnetic proportional control valve 510 may adjust the swash plate angle of the first hydraulic pump 100 by applying a pilot pressure corresponding to the inputted pump control signal to the first pump regulator 120. Accordingly, a discharge pressure of the first hydraulic pump 100 may be determined according to a current command value of the pump control signal.

In example embodiments, the working oil discharged from the first hydraulic pump 100 may be supplied to the first and second actuators 10 and 20 through the first and second control valves 300 and 310 respectively.

In particular, the first and second control valves 300 and 310 may be connected to the first hydraulic pump 100 through a first main hydraulic line 200. The first main hydraulic line 200 may be divided into a first center bypass line 210 and a parallel supply line 220. The first and second control valves 300, 310 may be installed sequentially in series in the first center bypass line 210.

The first main hydraulic line 200 may be divided into the first center bypass line 210 and at least one parallel line 230, and the second control valve 310 may be connected to at least one of the first center bypass line 210 and the parallel line 230. Even though the first control valve 300 is switched to close the first center bypass line 210, the second control valve 310 may be connected to the first hydraulic pump 100 by the parallel line 230 such that the working oil discharged from the first hydraulic pump 100 may be supplied to the second control valve 310.

Although it is not illustrated in the figures, an auxiliary control valve for controlling an operation of a third actuator may be installed in the first center bypass line 210, and the working oil discharged from the first hydraulic pump 100 may be supplied to the third actuator through the auxiliary control valve.

In example embodiments, the first actuator 10 may be the boom cylinder, and the second actuator 20 may be the arm cylinder. In this case, the first control valve 300 may be a boom control valve, and the second control valve 310 may be an arm control valve.

The first control valve 300, that is, the boom control valve may be connected to the first actuator 10, that is, a boom head chamber and a boom rod chamber of the boom cylinder through hydraulic lines. Accordingly, the first control valve 300 may be switched to selectively supply the working oil discharged from the first hydraulic pump 100 to the boom head chamber and the boom rod chamber. The working oil which drives the boom cylinder 10 may return to the drain tank T through a return hydraulic line 250.

The second control valve 310, that is, the arm control valve may be connected to the second actuator 20, that is, an arm head chamber and an arm rod chamber of the arm cylinder 20 through hydraulic lines. Accordingly, the second control valve 310 may be switched to selectively supply the working oil discharged from the first hydraulic pump 100 to the arm head chamber and the arm rod chamber. The working oil which drives the arm cylinder 20 may return to the drain tank T through a return hydraulic line 270.

In example embodiments, the control system for construction machinery may include a main control valve (MCV) as an assembly including the first and second control valves 300 and 310. The main control valve may include at least portions of the first center bypass line 210, the return lines 250, 270 and the parallel lines 230 therein, and may be provided as one package product including the first and second control valves 300, 310 installed sequentially therein. The main control valve may be an electro-hydraulic main control valve including an electro proportional pressure reducing valve (EPPRV) which controls a pilot working oil supplied to a spool of the control valve according to an inputted electrical signal. Alternatively, the main control valve may include a hydraulic control valve which is controlled by a pilot working oil in proportion to a manipulation signal.

In example embodiments, the first bypass control valve 400 may be installed downstream from the control valve 310 in the first center bypass line 210, and may variably control the amount of the working oil draining to the drain tank T through the first center bypass line 210.

In particular, the first bypass control valve 400 may be connected to the pilot pump via a second electromagnetic proportional control valve 520. The pilot working oil discharged from the pilot pump may be supplied to the first bypass control valve 400 through the second electromagnetic proportional control valve 520. The second electromagnetic proportional control valve 520 may apply a pilot pressure corresponding to a bypass control signal from the controller 500 to the first bypass control valve 400 to adjust an opening area of the first bypass control valve 400. For example, the second electromagnetic control valve may include an electro proportional pressure reducing valve (EPPRV). The second electromagnetic proportional control valve may generate a pilot signal pressure in proportion to an intensity of the received control signal, for example, current intensity.

When the bypass control signal is not inputted to the second electromagnetic proportional control valve 520, the first bypass control valve 400 may be closed. In this case, when there are no manipulation signals for the first and second actuators 10, 20, the working oil from the first hydraulic pump 100 may not return to the drain tank T through the first center bypass line 210.

When the bypass control single is inputted to the second electromagnetic proportional control valve 520, the first bypass control valve 400 may be opened by an opening area corresponding to the inputted bypass control signal. In this case, when there are no manipulation signals for the first and second actuators 10, 20, the amount of the working oil discharged from the first hydraulic pump 100 and returning to the drain tank T through the first center bypass line 210 may correspond to the opening area.

In example embodiments, the control system may further include a relief valve (not illustrated) which is installed upstream from the first bypass control valve 400 in the first main hydraulic line 200. The relief valve may limit the pressure of the working oil discharged from the first hydraulic pump 100 to be under a predetermined allowable pressure. When the pressure of the main hydraulic line 200 is above the allowable pressure, the relief valve may be opened such that the pressure is maintained under the allowable pressure.

In example embodiments, the control system may further include a second hydraulic pump 102 for supplying a wording oil to third and fourth actuators 12 and 22, third and fourth control valves 302, 304 configured to control a flow direction of the working oil discharged from the second hydraulic pump 102 to control the third and fourth actuators 12, 22, a second bypass control valve 402 installed in a second center bypass line 212 downstream from the third and fourth control valves 302, 304 to variably control an amount of the working oil draining to the drain tank through the second center bypass line 212, a second pump regulator 122 configured to control a discharge pressure of the second hydraulic pump 102 in proportion to a pump control signal generated according to a manipulation signal of an operator, and a third electromagnetic proportional control valve 522 configured to control a spool displacement of the second bypass control valve 402 in proportion to a bypass control signal generated according to the manipulation signal of an operator.

Operations of the second pump regulator 122, the second bypass control valve 402 and the third electromagnetic proportional control valve 522 may be substantially the same as those of the first pump regulator 120, the first bypass control valve 400 and the second electromagnetic proportional control valve 520, and thus, any further explanation concerning the above elements will be omitted.

In example embodiments, the controller 500 may receive the manipulation signal in proportion to a manipulation amount of an operator, and output a control signal (pump control signal, bypass control signal) corresponding to the manipulation signal to the first and second electromagnetic proportional control valves 510, 520. The first and second electromagnetic proportional control valves 510, 520 may output a secondary pressure in proportion to the control signal, to control the first pump regulator 120 and the first bypass control valve 400 using electrical signals.

Additionally, in case of the electro-hydraulic main control valve, the controller 500 may output pressure command signals as the control signal to the electro proportional pressure reducing valves, respectively. The electro proportional pressure reducing valves may output a secondary pressure in proportion to the pressure command signal to spools of the corresponding control valve, to control the spools using electrical signals.

Alternatively, in case of the hydraulic main control valve, the pilot pressure from a manipulation portion 600 may be supplied to the spools of the first and second control valves, to control the first and second control valves.

For example, the manipulation portion 600 may include a joystick, a pedal, etc. When an operator manipulates the manipulation portion 600, a manipulation signal corresponding to the manipulation may be generated. The controller 500 may receive the manipulation signal and control operations of the first hydraulic pump 100 and the first bypass control valve 400.

In example embodiments, as illustrated in FIG. 2, the controller 500 may include a sudden stop determiner 502 determining whether or not a sudden stop manipulation of an actuator occurs, based on a joystick manipulation signal generated when the joystick of the manipulation portion 600 is manipulated, a calculator 504 determining an opening area of the first bypass control valve 400 when the sudden stop manipulation of the actuator occurs, and an output portion 506 outputting a bypass control signal for opening the first bypass control valve 400 according to the calculated opening area.

The sudden stop determiner 502 may receive manipulation signals of the first and second actuators 10, 20, for example, joystick pilot pressure, joystick displacement amount, etc., and may determine that the sudden stop manipulation occurs when a decreasing inclination is greater than a predetermined value.

Additionally, the sudden stop determiner 502 may determine that the sudden stop manipulation does not occur when the decreasing inclination of the manipulation signal of any one of the actuators 10, 20 during a multiple operation of the actuators 10, 20 is less than the predetermined value.

The calculator 504 may predict/determine a pump peak which occurs when the first center bypass line 200 is closed, and may calculate the opening area, an opening duration, a closing inclination, etc. of the first bypass control valve 400, based on a size and duration time of the predicted/determined pump peak. For example, the calculator 504 may calculate the opening area of the first bypass control valve 400 according to the duration time of the predicted/determined pump peak. The calculator 504 may determine the closing speed of the first bypass control valve 400 based on whether or not a secondary pump peak occurs when the first bypass control valve 400 is closed again.

Additionally, the calculator 504 may receive a swash plate angle, a discharge pressure, etc. of the first hydraulic pump 100 from a pump swash plate angle sensor 110 and a pump discharge pressure sensor 130, and may determine a minimum opening area of the first bypass control valve 400 when the amount of the working oil discharged from the hydraulic pump 100 is greater than a predetermined value.

The output portion 506 may output the bypass control signal for opening the first bypass control valve 400 according to the calculated opening area. The output portion 506 may output the bypass control signal corresponding to the opening area, the opening time and the closing inclination of the first bypass control valve 400 in case of the sudden stop manipulation.

The second electromagnetic proportion control valve 520 may supply a pilot signal pressure for controlling the opening area of the first bypass control valve 400 according to a control signal inputted from the output portion 506.

Thus, in case of the sudden stop manipulation of the actuator, the first bypass control valve 400 may be opened by the calculated opening area and then may be closed at the calculated closing inclination. In case of no sudden stop manipulation of the actuator, the first bypass control valve 400 may be maintained to be closed.

Additionally, when the amount of the working oil discharged from the first hydraulic pump 100 is greater than the predetermined value before the sudden stop manipulation of the actuator, the first bypass control valve 400 may be opened in advance by the predetermined minimum area. As such, in case that the first bypass control valve 400 is opened in advance by the minimum predetermined area, the first bypass control valve 400 may be opened rapidly in the sudden stop manipulation of the actuator. Thus, a response speed of the first bypass control valve 400 may be improved more. In this case, the first hydraulic pump 100 may be controlled such that the amount of the working oil to be discharged may be greater than the predicted amount in consideration that the first bypass control valve 400 is opened in advance.

As illustrated in FIG. 3, when the joystick of the manipulation portion 600 corresponding to the second actuator 20 is manipulated, the second control valve 310 may be switched and the working oil discharged from the first hydraulic pump 100 may be supplied to the second actuator 20. In here, the first bypass control valve 400 may be maintained to be closed or be opened by the minimum opening area.

As illustrated in FIG. 4, in case of the sudden stop manipulation of the second actuator 20, the second control valve 310 may return to a neutral position, and the first bypass control valve 400 may be opened by a calculated opening area. Additionally, the swash plate angle of the first hydraulic pump 100 may be decreased according to the pump control signal such that the discharge amount of the working oil may be decreased.

Referring to FIG. 5, graphs of the pilot pressure A at the spool of the control valve, the pump pressure B, the opening area C of the first bypass control valve 400 and the pump discharge amount D in case of the joystick sudden stop manipulation are illustrated.

As an operator starts to manipulate the joystick for driving the actuator, the pilot pressure A may be increased. Then, at the joystick sudden stop manipulation (t2), the pilot pressure A may drop sharply, the spool of the control valve may return rapidly to the neutral position. If the first center bypass line 210 is closed by the first bypass control valve 400, the pressure of the first center bypass line 210, that is, pump pressure B generated by the working oil discharged from the hydraulic pump 100 may rise sharply so that the pump peak occurs.

In example embodiments, the controller 500 may open the first bypass control valve 400 in advance by the minimum opening area A1 at times (t0~t2) before the joystick sudden stop manipulation. The controller 500 may open the first bypass control valve 400 by the predetermined opening area (A2) at the joystick sudden stop manipulation (t2~t3) and then may close at a constant inclination (t3~t4).

There may be physical dynamic characteristic differences between the first hydraulic pump 100 and the control valve. In particular, because the response time of the control valve is relatively faster than the response time of the first hydraulic pump 100, in case of the sudden stop manipulation even though the control valve returns already to the neutral position, the working oil may be discharged from the first hydraulic pump 100 so that the pump discharge pressure may rise rapidly. In here, the first bypass control valve 400 may be opened rapidly such that the discharged working oil may return to the drain tank T through the first bypass control valve 400, to thereby prevent the pump peak which may occur in the main hydraulic line 200 in case of the sudden stop manipulation.

In example embodiments, the control system for construction machinery may further sensors installed in the working oil supply line such as the first and second main hydraulic lines 200, 202 to detect pressures, and sensors for detecting positions, angles, pressures, etc. of the first to fourth actuators 10, 12, 20, 22. For example, the sensor may detect the pressure of the working oil supply line or the position of the actuators. In this case, the controller 500 may receive the pressure signal of the working oil supply line or the position signal of the actuator, and may determine whether or not a pump peak occurs due to external impacts or loads.

For example, if the bucket encounters rock in a ground during an excavation operation, a pump peak may occur due to a load exerted on the bucket cylinder. In here, the controller 500 may determine whether or not the pump peak occurs according to the pressure increase in the working oil supply line or the sudden stop of the actuator. That is, when it is determined that the actuator stops suddenly by the external load, the controller 500 may determine that the pump peak occurs, and may output the bypass control signal to the second electromagnetic control valve 520. When the bypass control signal is inputted to the second electromagnetic control valve 520, the first bypass control valve 400 may be opened by the opening area corresponding to the inputted bypass control signal, to thereby prevent the pump pressure peak.

Figure 6:
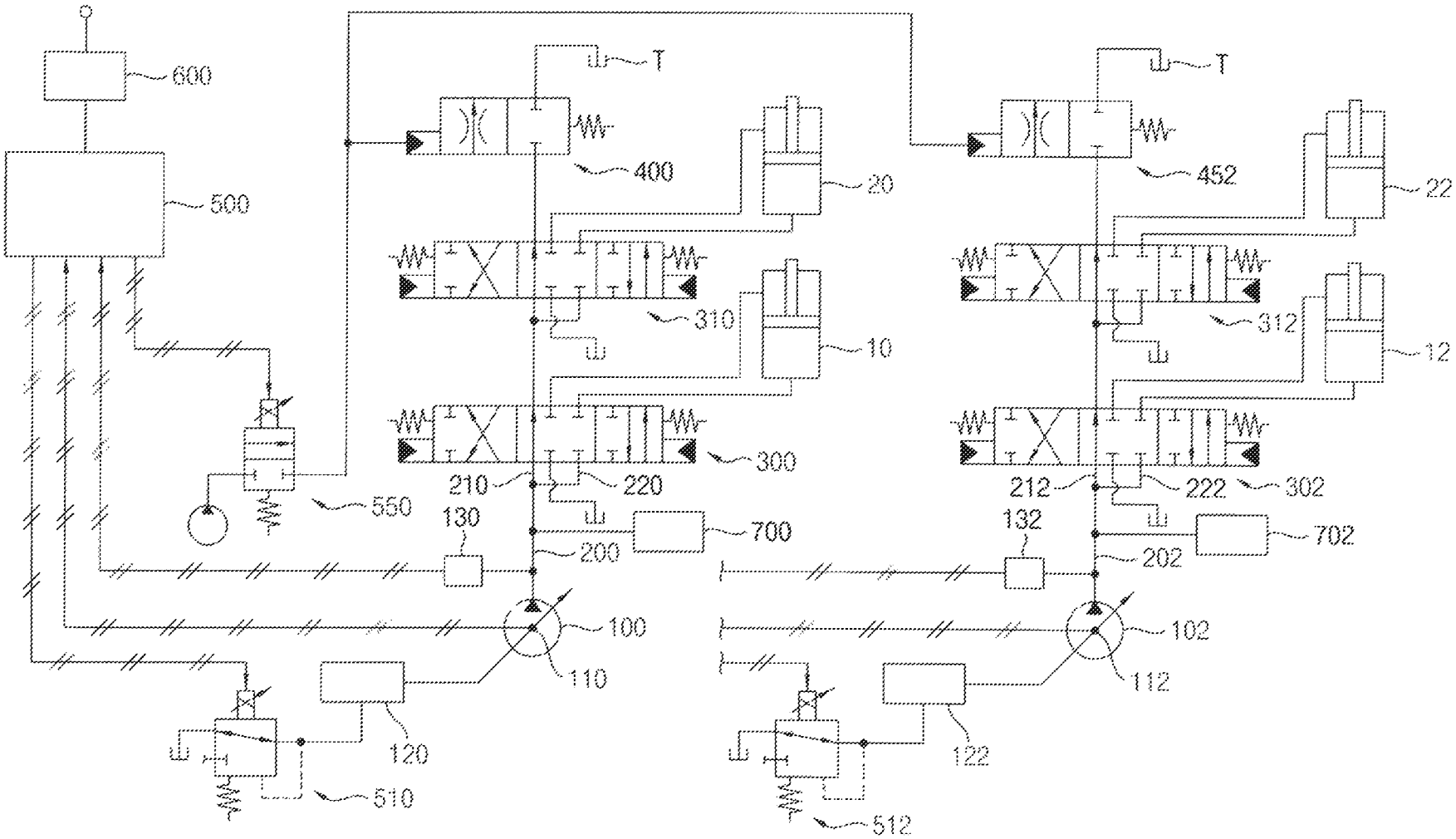
FIG. 6 is a hydraulic circuit diagram illustrating a control system for construction machinery in accordance with a comparative example embodiment.

FIG. 6 is a hydraulic circuit diagram illustrating a control system for construction machinery in accordance with comparative example embodiment.

Referring to FIG. 6, a control system for construction machinery in accordance with a comparative example embodiment may include first and second bypass valves 450, 452 installed in first and second center bypass lines 210, 212 respectively, and a solenoid valve 550 for opening and closing the first and second bypass valves 450, 452. Additionally, the control system for construction machinery in accordance with a comparative example embodiment may include first and second pump peak reducing valves 700, 702 installed in first and second main hydraulic lines 200, 202 respectively to evacuate the working oil discharged from the first and second hydraulic pumps 100, 102 to thereby prevent a pump peak.

In the control system for construction machinery in accordance with a comparative example embodiment, the solenoid valve 550 may be turned ON at an initial engine ignition time or a warm up after ignition to open the first and second center bypass lines 210, 212, and may be tuned OFF during a general operation to close the first and second center bypass lines 210, 212.

Thus, because the first and second center bypass lines 210, 212 are closed in case of the joystick sudden stop manipulation, the pressure of the working oil discharged from the first and second hydraulic pumps 100, 102 may rise rapidly. And then, the first and second pump peak reducing valves 700, 702 may evacuate the working oil discharged from the first and second hydraulic pumps 100, 102 late to reduce the increased pump pressure. The first and second center bypass lines 210, 212 may be opened and closed by one solenoid valve 550.

On the contrary, in the control system of construction machinery in accordance with example embodiments, as illustrated in FIG. 1, the opening areas of the first and second center bypass lines 210, 212 may be adjusted by the second and third electromagnetic proportional valves 520, 522 respectively. In case of the joystick sudden stop manipulation, whether or not the sudden stop manipulation occurs may be determined through manipulation signals of the joystick in advance and then the first and second center bypass lines 210, 212 may be opened to remove the pump peak. Accordingly, a center bypass line control of each of the first and second hydraulic pumps 100, 102 may be performed independently, to prevent unnecessary flow loss. Further, the second and third electromagnetic proportional control valves 520, 522 may perform functions to temporarily open the first and second center bypass lines 210, 212 at the initial engine ignition time or the warm up after ignition similarly to the comparative example embodiment. However, differently to the comparative example embodiments using the solenoid valve, in example embodiments, the electromagnetic proportional control valve may be used to prevent the bypass lines from being opened rapidly or more than needed.

Hereinafter, a control method for construction machinery using the control system in FIG. 1 will be explained.

Figure 7:
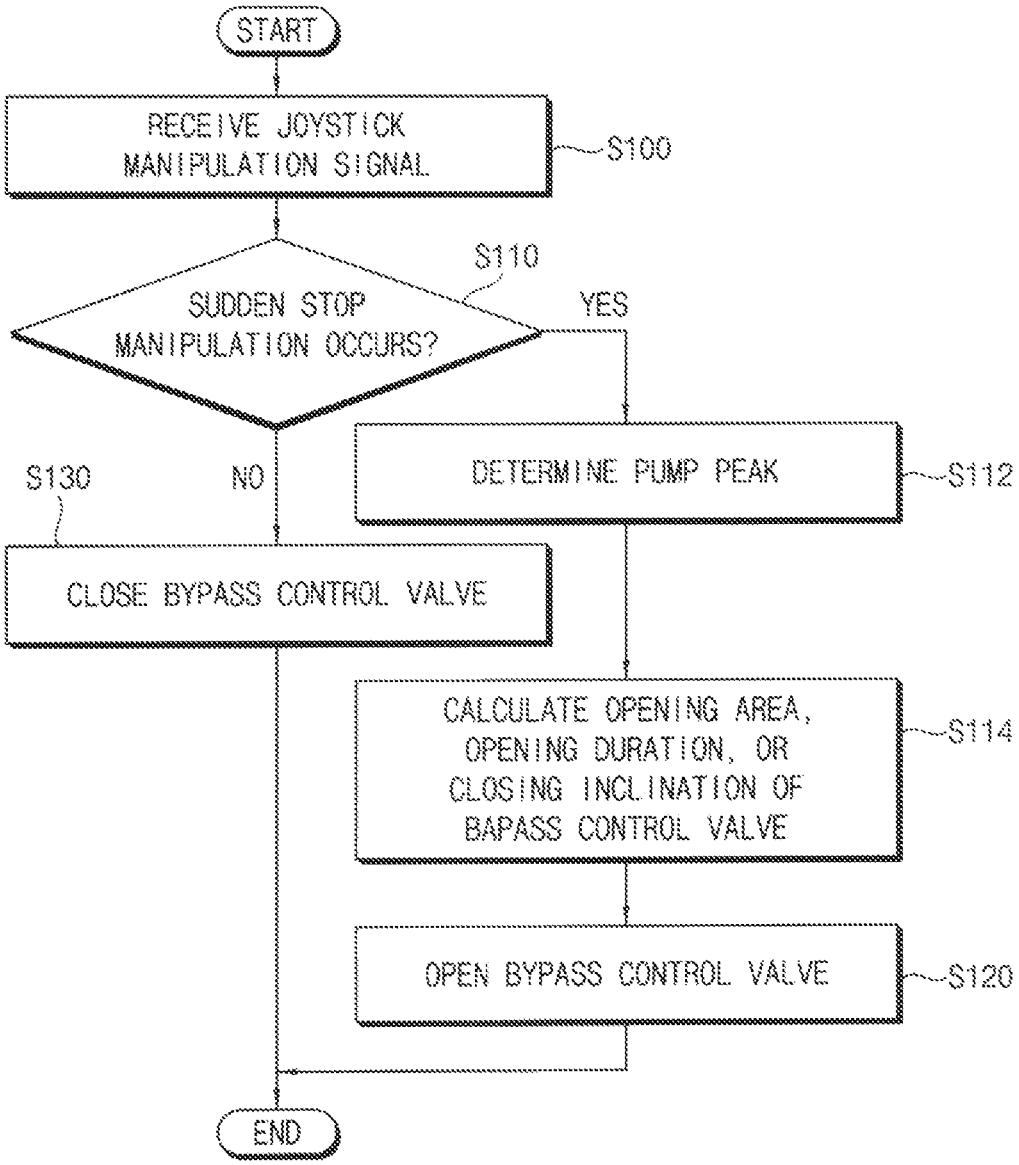
FIG. 7 is a flow chart illustrating a control method for construction machinery in accordance with example embodiments.

FIG. 7 is a flow chart illustrating a control method for construction machinery in accordance with example embodiments.

Referring to FIGS. 1, 2 and 7, a manipulation signal of an operator for first and second actuators 10 and 20 and a discharge pressure and a swash plate angle of a first hydraulic pump 100 may be received (S100), and then, whether or not a sudden stop manipulation occurs may be determined based on the manipulation signal (S110). Then, in case of the sudden stop manipulation, the controller 550 may determine whether or not a pump peak occurs due to external impacts or loads based on the pressure signal of the working oil supply line or the position signal of the actuator (S112) and calculate an opening area, an opening duration time, or a closing inclination, etc. of the first bypass control valve 400 based on a size and duration time of the pump peak (S114), and then a first bypass control valve 400 may be opened (S120). In case of no sudden stop manipulation, the first bypass control valve 400 may be closed (S130).

In example embodiments, the manipulation signals for the first and second actuators 10, 20, for example, joystick pilot pressure, joystick displacement amount, etc., may be received, and it may be determined that the sudden stop manipulation occurs when a decreasing inclination is greater than a predetermined value.

Additionally, it may be determined that the sudden stop manipulation does not occur when the decreasing inclination of the manipulation signal for any one of the actuators 10, 20 during a multiple operation of the actuators 10, 20 is less than the predetermined value.

In here, a pump peak which occurs in case of the sudden stop manipulation when the first center bypass line 200 is closed may be predicted/determined, and an opening area, an opening duration time, a closing inclination, etc. of the first bypass control valve 400 may be calculated based on a size and duration time of the predicted/determined pump peak. For example, the opening area of the first bypass control valve 400 according to the duration time of the predicted/determined pump peak may be calculated. The closing speed of the first bypass control valve 400 may be determined based on whether or not a secondary pump peak occurs when the first bypass control valve 400 is closed again.

Additionally, the swash plate angle and the discharge pressure of the first hydraulic pump 100 may be used to calculate a minimum opening area of the first bypass control valve 400 when the amount of the working oil discharged from the first hydraulic pump 100 is greater than a predetermined value.

In case of the sudden stop manipulation, the first bypass control valve 400 may be opened by the calculated opening area and then may be closed at the calculated closing inclination. When the amount of the working oil discharged from the first hydraulic pump 100 is greater than the predetermined value before the sudden stop manipulation, the first bypass control valve 400 may be opened in advance by the minimum predetermined area. In case of no sudden stop manipulation, the first bypass control valve 400 may be maintained to be closed.

As mentioned above, in case of the joystick sudden stop manipulation, the first bypass control valve 400 installed downstream from the main control valve in the center bypass line 210 may be opened such that the working oil discharged from the first hydraulic pump 100 may return to the drain tank T through the first center bypass line 210. In case of no joystick sudden stop manipulation, the first bypass control valve 400 may be closed.

Thus, in a closed center type of a hydraulic system, in case of the joystick sudden stop manipulation, the pump peak which occurs due to physical dynamic characteristic differences between the hydraulic pump and the control valve may be prevented.

The present invention has been explained with reference to preferable embodiments, however, those skilled in the art may understand that the present invention may be modified or changed without being deviated from the concept and the scope of the present invention disclosed in the following claims.

THE DESCRIPTION OF THE REFERENCE NUMERALS

| | |
|---|---|
| 10: first actuator | 12: third actuator |
| 20: second actuator | 22: fourth actuator |
| 100: first hydraulic pump | 102: second hydraulic pump |
| 110, 112: pump swash plate angle sensor | 120: first pump regulator |
| 122: second pump regulator | 130, 132, pump discharge pressure sensor |
| 200: first mam hydraulic line | 202: second main hydraulic line |
| 210: first center bypass line | 212: second center bypass line |
| 220: parallel supply line | 300: first control valve |
| 302: third control valve | 310: second control valve |
| 312: fourth control valve | 400: first bypass control valve |

-continued

| | |
|---|---|
| 402: second bypass control valve | 500: controller |
| 502: sudden stop determiner | 504: calculator |
| 506: output portion | 510: first electromagnetic proportional control valve |
| 520: second electromagnetic proportional control valve | 522: third electromagnetic proportion control valve |
| 600: manipulation portion | |

The invention claimed is:

1. A control system for construction machinery, comprising:

a hydraulic pump;

at least one control valve installed in a center bypass line connected to the hydraulic pump, and configured to control a flow direction of a working oil discharged from the hydraulic pump to selectively supply the working oil to an actuator;

a bypass control valve installed downstream from the control valve in the center bypass line to variably control an amount of the working oil draining to a drain tank through the center bypass line; and a controller configured to control operations of the hydraulic pump and the bypass control valve according to a manipulation signal of an operator, wherein the controller is configured to determine whether or not a sudden stop manipulation of the actuator occurs based on the manipulation signal of the operator, and open the bypass control valve to prevent a pump peak when the sudden stop manipulation occurs.

2. The control system for construction machinery of claim 1, wherein the controller comprises a calculator configured to determine an opening area of the bypass control valve based on a size and/or duration time of the pump peak that is expected to occur when the sudden stop manipulation of the actuator occurs; and an output portion configured to output a control signal for opening the bypass control valve according to the calculated opening area to prevent the pump peak when the sudden stop manipulation occurs.

3. The control system for construction machinery of claim 2, wherein the calculator of the controller is configured to determine an opening duration or a closing inclination of the bypass control valve based on the size and/or duration time of the expected pump peak.

4. The control system for construction machinery of claim 2, wherein the controller is configured to open the bypass control valve in advance of determining the sudden stop manipulation occurrence by a predetermined minimum area when an amount of the working oil discharged from the hydraulic pump is greater than a predetermined value.

5. The control system for construction machinery of claim 2, further comprising an electromagnetic proportional control valve configured to apply a pilot pressure corresponding to the control signal inputted from the controller to control the opening area of the bypass control valve.

6. The control system for construction machinery of claim 5, further comprising:

a second hydraulic pump;

a second control valve installed in a second center bypass line connected to the second hydraulic pump, and configured to control a flow direction of a working oil discharged from the second hydraulic pump to selectively supply the working oil to a second actuator;

a second bypass control valve installed downstream from the second control valve in the second center bypass line to variably control an amount of the working oil draining to a drain tank through the second center bypass line; and a second electromagnetic proportional control valve configured to apply a pilot pressure corresponding to the control signal inputted from the controller to control an opening area of the second bypass control valve.

7. The control system for construction machinery of claim 1, wherein when no sudden stop manipulation of the actuator occurs, the controller is configured to close the bypass control valve.

8. The control system for construction machinery of claim 1, further comprising:

a pump regulator configured to adjust a swash plate angle of the hydraulic pump according to the control signal inputted from the controller.

9. A control method for construction machinery, comprising:

providing a hydraulic system including a hydraulic pump, at least one control valve installed in a center bypass line connected to the hydraulic pump to control an operation of an actuator, and a bypass control valve installed downstream from the control valve in the center bypass line to variably control an amount of the working oil draining to a drain tank through the center bypass line;

determining whether or not a sudden stop manipulation of the actuator occurs based on a manipulation signal of the operator; and opening the bypass control valve to prevent a pump peak when the sudden stop manipulation occurs.

10. The control method for construction machinery of claim 9, further comprising:

determining an opening area of the bypass control valve based on the size and/or duration time of the pump peak that is expected to occur when the sudden stop manipulation of the actuator occurs; and outputting a control signal for opening the bypass control valve according to the calculated opening area to prevent the pump peak when the sudden stop manipulation occurs.

11. The control method for construction machinery of claim 10, further comprising:

closing the bypass control valve when no sudden stop manipulation of the actuator occurs.

12. The hydraulic control method for construction machinery of claim 11, further comprising:

opening the bypass control valve in advance of determining the sudden stop manipulation occurrence by a predetermined minimum area when an amount of the working oil discharged from the hydraulic pump is greater than a predetermined value.

13. The control method for construction machinery of claim 10, wherein said opening the bypass control valve comprises applying a pilot pressure for opening the bypass control valve according to the determined opening area, to the bypass control valve through an electromagnetic proportional control valve.

14. The control method for construction machinery of claim 9, further comprising:

controlling a swash plate angle of the hydraulic pump according to the manipulation signal of the operator of the actuator.

15. The control method for construction machinery of claim 10, further comprising determining an opening duration or a closing inclination of the bypass control valve based on a size and/or duration time of the expected pump peak.

* * * * *